US008327585B2

(12) United States Patent
Foster

(10) Patent No.: US 8,327,585 B2
(45) Date of Patent: Dec. 11, 2012

(54) WEATHERSEAL WITH REMOVABLE PROTECTIVE COATING

(75) Inventor: Mark D. Foster, Pittsford, NY (US)

(73) Assignee: Schlegel Systems, Inc., Rochester, NY (US)

( * ) Notice: Subject to any disclaimer, the term of this patent is extended or adjusted under 35 U.S.C. 154(b) by 627 days.

(21) Appl. No.: 12/143,483

(22) Filed: Jun. 20, 2008

(65) Prior Publication Data

US 2009/0313900 A1 Dec. 24, 2009

(51) Int. Cl.
*E06B 7/16* (2006.01)

(52) U.S. Cl. ..... 49/475.1; 49/489.1

(58) Field of Classification Search ..... 49/475.1, 49/489.1, 496.1
See application file for complete search history.

(56) References Cited

U.S. PATENT DOCUMENTS 4,078,106 A * 3/1978 Lind ..... 428/36.1
4,328,273 A * 5/1982 Yackiw ..... 428/122
4,535,564 A * 8/1985 Yackiw ..... 49/489.1
4,847,024 A * 7/1989 Loren ..... 264/46.6
4,898,760 A * 2/1990 Halberstadt et al. ..... 428/122
4,930,257 A * 6/1990 Windgassen ..... 49/504
5,007,203 A * 4/1991 Katrynuik ..... 49/493.1
5,512,601 A * 4/1996 Halberstadt et al. ..... 521/79
5,943,825 A * 8/1999 Procton et al. ..... 49/469
6,111,357 A * 8/2000 Fleming et al. ..... 313/509
D571,932 S * 6/2008 Van Camp et al. ..... D25/119
7,718,251 B2 * 5/2010 Huntress et al. ..... 428/304.4
2008/0206498 A1 * 8/2008 Allen ..... 428/34.9

OTHER PUBLICATIONS

3M Co-Extruded Multi-Polymer Protective Tapes, 2A87, 2A88, 2A89, 3M Corporation, pp. 1-3.

* cited by examiner

*Primary Examiner* — Jerry Redman
(74) *Attorney, Agent, or Firm* — Stephen B. Salai, Esq.; Michael J. Didas, Esq.; Harter Secrest & Emery LLP

(57) ABSTRACT

A new method of making and manufacturing foam weather stripping, using a foam filled profile that is encapsulated with an outer liner and a removable film. The film is precisely introduced to the liner using adjustable guides. Just before the film is introduced to the liner the release liner is striped from the film and carried away using a scrap takeaway system for recycling. The liner and film are then introduced into proprietary tooling where the foam, liner, insert, and film is folded upon itself. After the actual construction of the said profile, it is then inserted into a door or window using a kerf or tape application. After the installation of the weather-stripping in the door or window it can then be painted or finished in a variety of ways. After the finish has dried the film protecting the weather strip can then be pealed away exposing a clean undisturbed weather strip.

15 Claims, 4 Drawing Sheets

WEATHERSEAL WITH REMOVABLE PROTECTIVE COATING

BACKGROUND OF THE INVENTION

1. Field of the Invention

This invention relates generally to weatherseals and more particularly to weatherseals for doors and windows that are provided to builders or homeowners in unpainted condition and painted after installation.

2. Description of Related Art

Foam weather stripping has been, and still is applied around windows and doors. Typically this is a complex geometric shape manufactured in large quantities in continuous lengths or cut lengths for this purpose. The typical standard for foam-filled weather stripping is a geometric profile that is inserted into a door or window kerf and also at times being applied using adhesive tape.

Conventional door and window weatherseals are generally manufactured separately from the doors and windows and are installed during assembly. The weatherseals are often positioned at locations on the doors and windows that are adjacent to areas that must be painted after installation to match the house or building in which the doors or windows are installed. While it is possible to appropriately mask the weatherseal adjacent to the areas to be painted with masking tape or the like, this is not always done and paint may be inadvertently applied to the weatherseals. The paint may be difficult or impossible to remove and is at least unsightly. In some instances, the paint can interfere with the operation of the weatherseal because it destroys the sealing surface or reduces the efficacy of the sealing surface that engages the door or window.

In the past, at least with regard to an extruded weatherseal, one approach to this problem has been to co-extrude a removable protective layer of material on to the weatherseal at the time of manufacture. The extruded layer could be left in place up through the time the door or window was painted and thereafter removed providing a clean weatherseal sealing surface. A disadvantage of this approach has been that the co-extruded material had a coefficient of thermal expansion that is at least somewhat different from the underlying extruded material and consequently if the weatherseal was stored for an appreciable length of time prior to installation, expansion or shrinkage of the weatherseal material and the protective layer would cause the weatherseal to bow. In some cases, where the storage time was long enough, the bow would induce a permanent set in the weatherseal which made it difficult to install. Moreover, even the most effective co-extrusions were somewhat difficult to remove and left a residue on the weatherseal surface.

Foam based weatherseals having a foam core surrounded by a layer of plastic material, such as polyethylene, forming the sealing surface cannot be protected with a co-extruded seal of the type heretofore used. In addition, it is desirable to eliminate some of the disadvantages of the known protective layer such as the unequal coefficients of expansion, the undesirable set, and the residue left after the protective layer is removed. Accordingly, there is a need in the art for a weatherseal, especially a foam core weatherseal having a polyethylene layer wrapped around the foam core, that includes a protective layer applied at the time of manufacture and easily removed after installation and painting that does not cause the weatherseal to bow, leaves no undesirable residue, and is easy and inexpensive to apply and remove.

SUMMARY OF THE INVENTION

The object of the present invention is to provide an improved foam weather strip seal and method of making the same. An advantage of the foam weather strip according to the present invention is that the door or window can be finished in a number of ways such as paint or stain either at the point of construction or out in the field where the door or window is being installed. After the finishing process the protective film is removed from the foam weather strip, revealing a clean undisturbed weather strip. The embodiments of the present invention can be used, for example, in windows, such as PVC or wood windows. The weather stripping may also be used in doors or insect screens. The removable film may contain a number of individual printings, for example, 'REMOVE AFTER PAINTING'. The removable film may be a number of colors, for example, clear, blue, and red.

The invention also includes machinery for forming such weather-stripping, and a method for making such weather-stripping.

Briefly stated and in accordance with the present preferred embodiment of the invention, a weatherseal for a door or window includes a foam core, a polyethylene sealing layer wrapped around the core and a strip of compatible material most desirably a polyethylene material attached to the polyethylene wrap with an acrylic adhesive masking at least a portion of the polyethylene wrap that is exposed to paint when the door or window is painted.

In accordance with another aspect of the invention, the protective layer is applied to the polyethylene coating before the coating is wrapped around the foam core thereby making the application of the protective layer simple and inexpensive.

BRIEF DESCRIPTION OF THE SEVERAL VIEWS OF THE DRAWING(S)

DETAILED DESCRIPTION OF THE INVENTION

Figure 1:
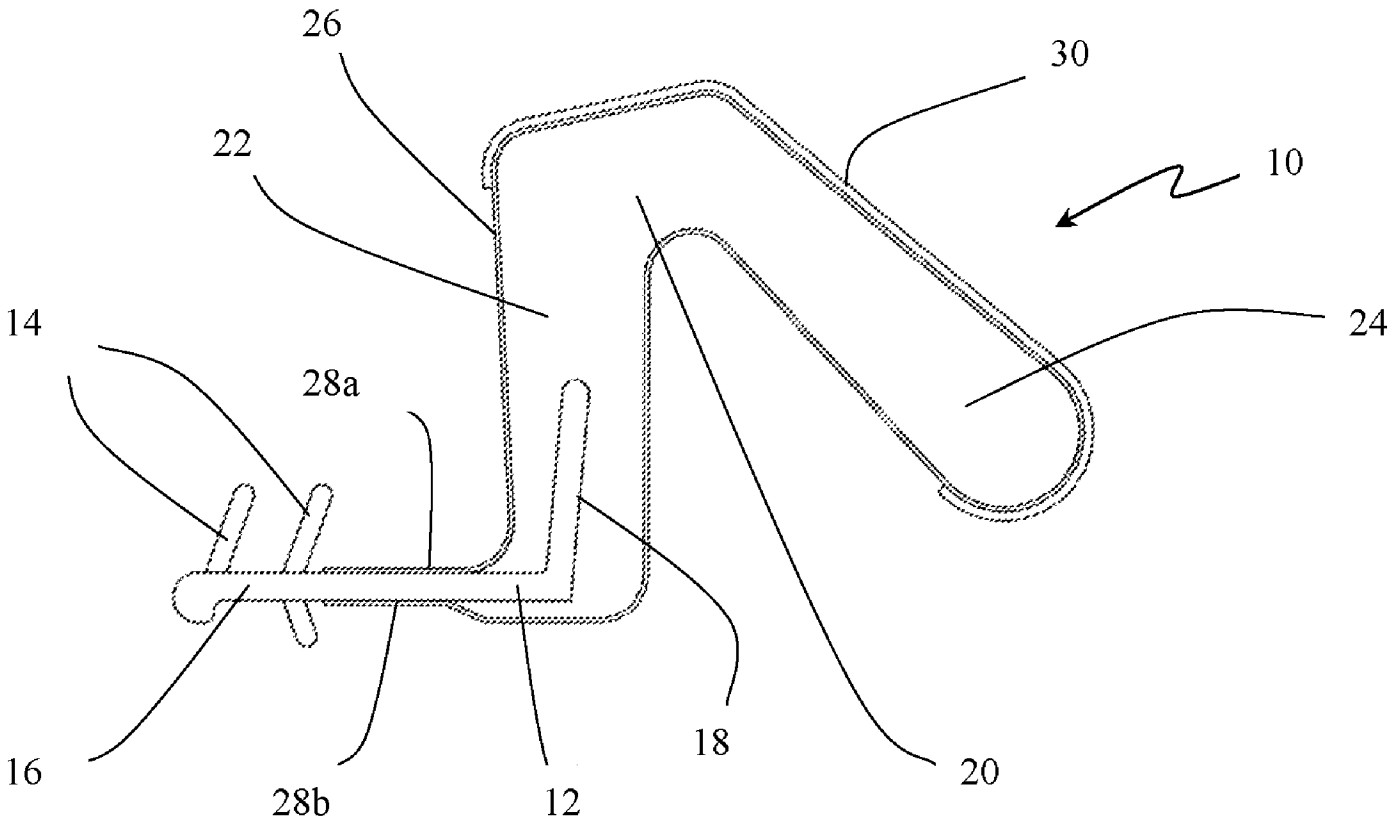
FIG. 1 is a cross-section of a weather stripping according to a preferred embodiment of the invention.
Figure 2:
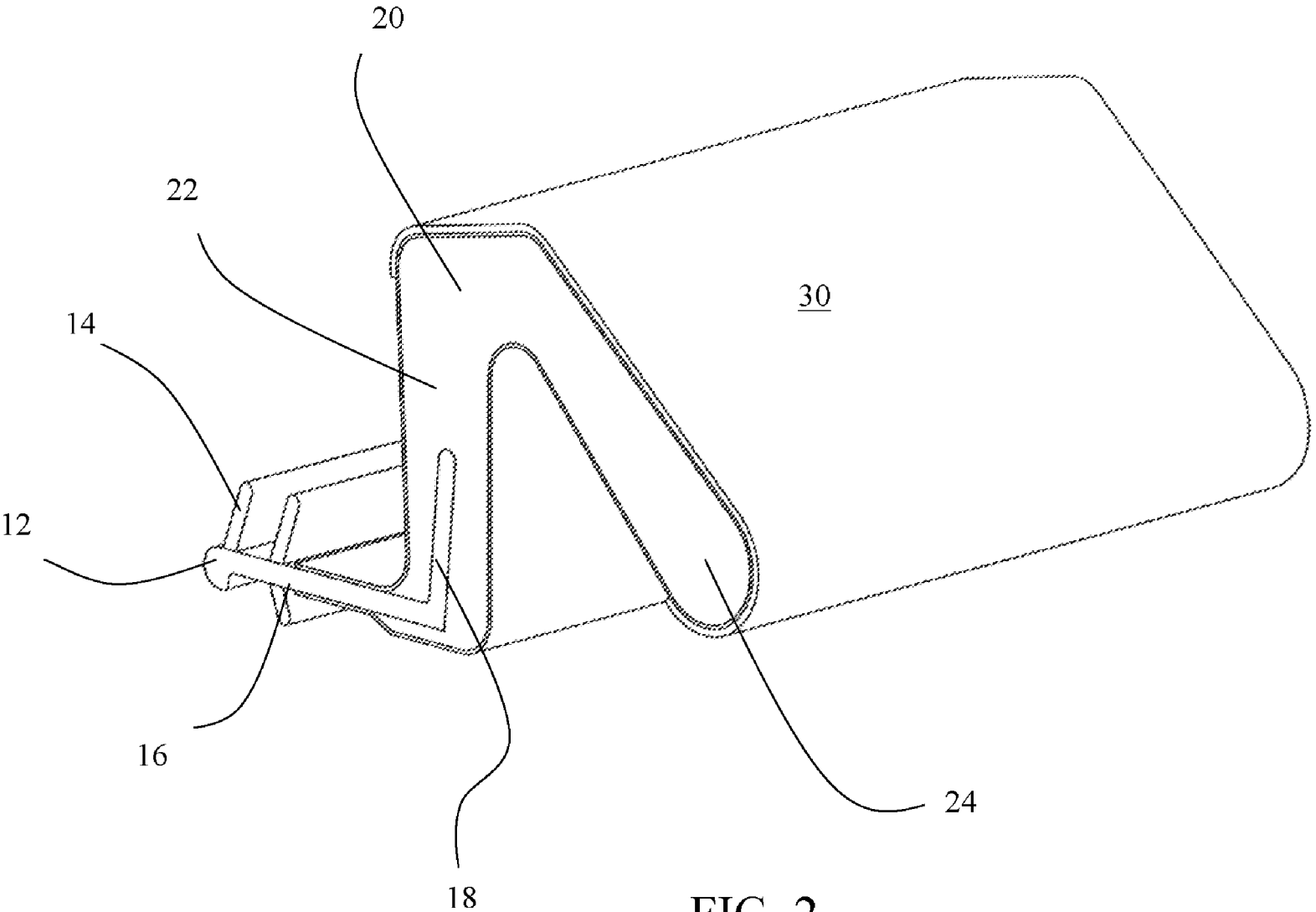
FIG. 2 is a perspective view of the weather stripping of FIG. 1.

FIG. 1 is a cross section of a door seal in accordance with this invention and FIG. 2 is a right front perspective view thereof. The door seal indicated generally at 10 includes a preferably molded plastic spine 12 having a plurality of flexible fins 14 extending from one end thereof for engaging a kerf cut in a door or window frame. The spine 12 is generally L shaped and has a base portion 16 from which the flexible fins 14 extend and a foot 18 extending at approximately a right angle from the base portion 16 for supporting the remainder of the door seal 10. Preferably, the spine 12 is made from extruded molded plastic such as Polypropylene and is semi-rigid, that is to say stiff enough to support the door seal but flexible enough to allow it to be inserted into a kerf in a door frame and to accommodate manufacturing imperfections in the kerf.

A foam core 20 is attached to the foot 18 of the spine 12. The foam core 20 has a generally V-shaped configuration and includes a support leg 22 enveloping the foot of the spine and a sealing leg 24 adapted to engage the moving portion of a door or window in connection with which the seal is used. The foam body 20 preferably is formed from open or closed cell foam such as polyetherurethane.

The foam body 20 is surrounded by a liner 26 having two edges 28*a*, 28*b* attached to upper and lower surfaces of the base portion 12 of the spine 12 by an adhesive, ultrasonic welding or the like. Preferably the liner 26 is made from a coated fabric material formed from polyethylene or the like that preferably can be directly bonded to the surface of the spine 12.

A layer of removable protective tape 30 is attached to a portion of the surface of the liner 26. Preferably, the tape 30 is a co-extruded multi polymer protective tape such as 2A87, 2A88, or 2A89 manufactured by 3-M Company. The tape 30 is removeably secured to the surface of the liner with an acrylic adhesive that will not lift after application to a textured surface such as the surface of the liner, will withstand temperatures consistent with the storage and operating temperatures of the door seal, such as 168 degrees Fahrenheit, and has a coefficient of thermal expansion consistent with the coefficient of thermal expansion of the rest of the door seal so as to avoid deformation, especially warping of the door seal, both prior to and after installation in a door or window. Preferably the tape covers that portion of the door seal that would be exposed to painting when the door seal is installed in the kerf of a door so that after installation, the door can be painted without the need to otherwise mask off or avoid painting the seal thereby rendering the painting operation simpler and less expensive. After the paint on the door and seal have dried, the protective layer 30 is readily peeled off the door seal leaving essentially no residue.

Preferably, the removable protective tape 30 is marked with a legend such as "remove after painting" so as to avoid inadvertently leaving the tape in place and rendering the appearance of the completed door or window unsightly or otherwise unsatisfactory.

Figure 3:
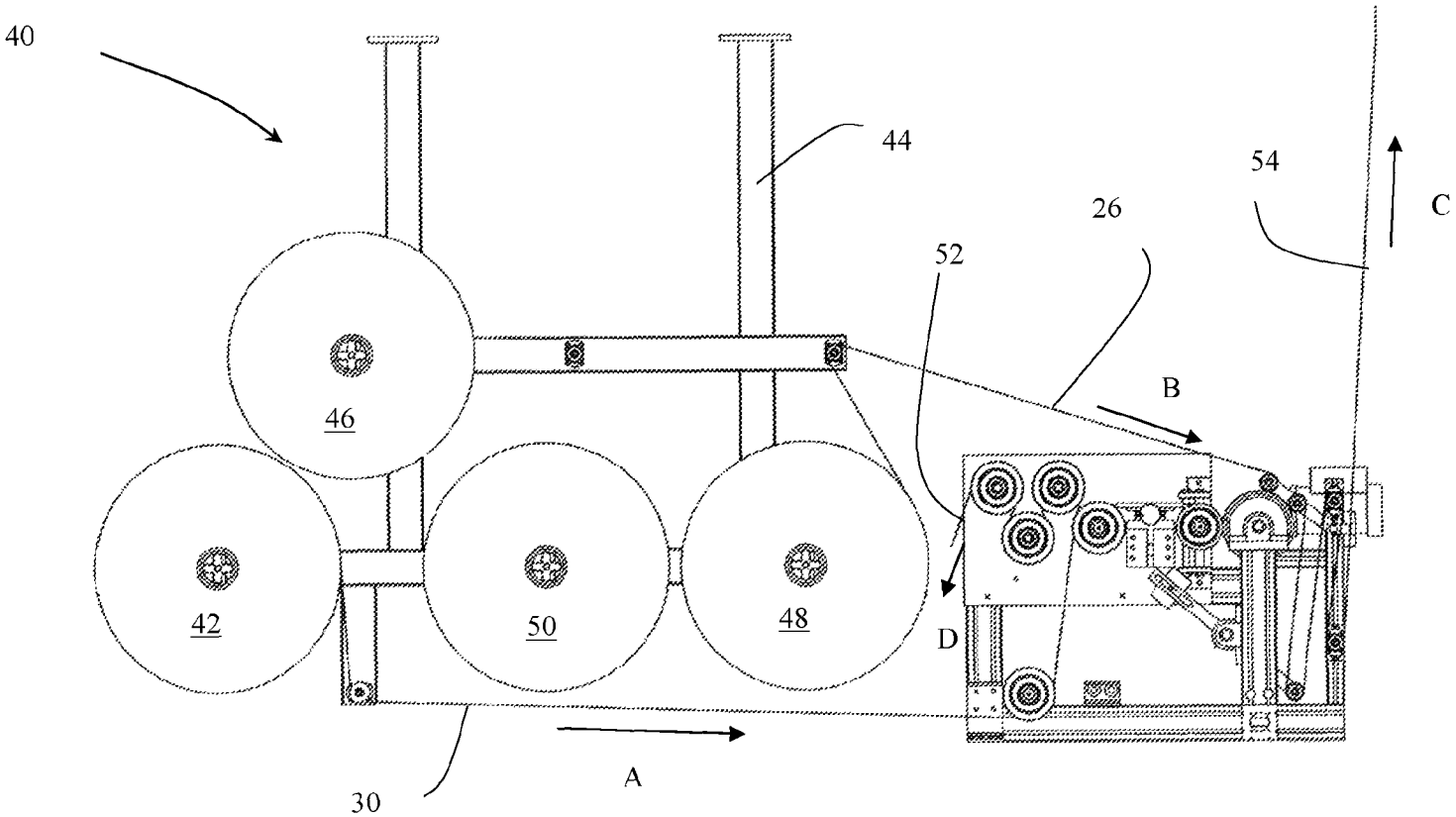
FIG. 3 is a side elevation of a machine for applying the protective tape to a door or window seal during manufacture of the seal
Figure 4:
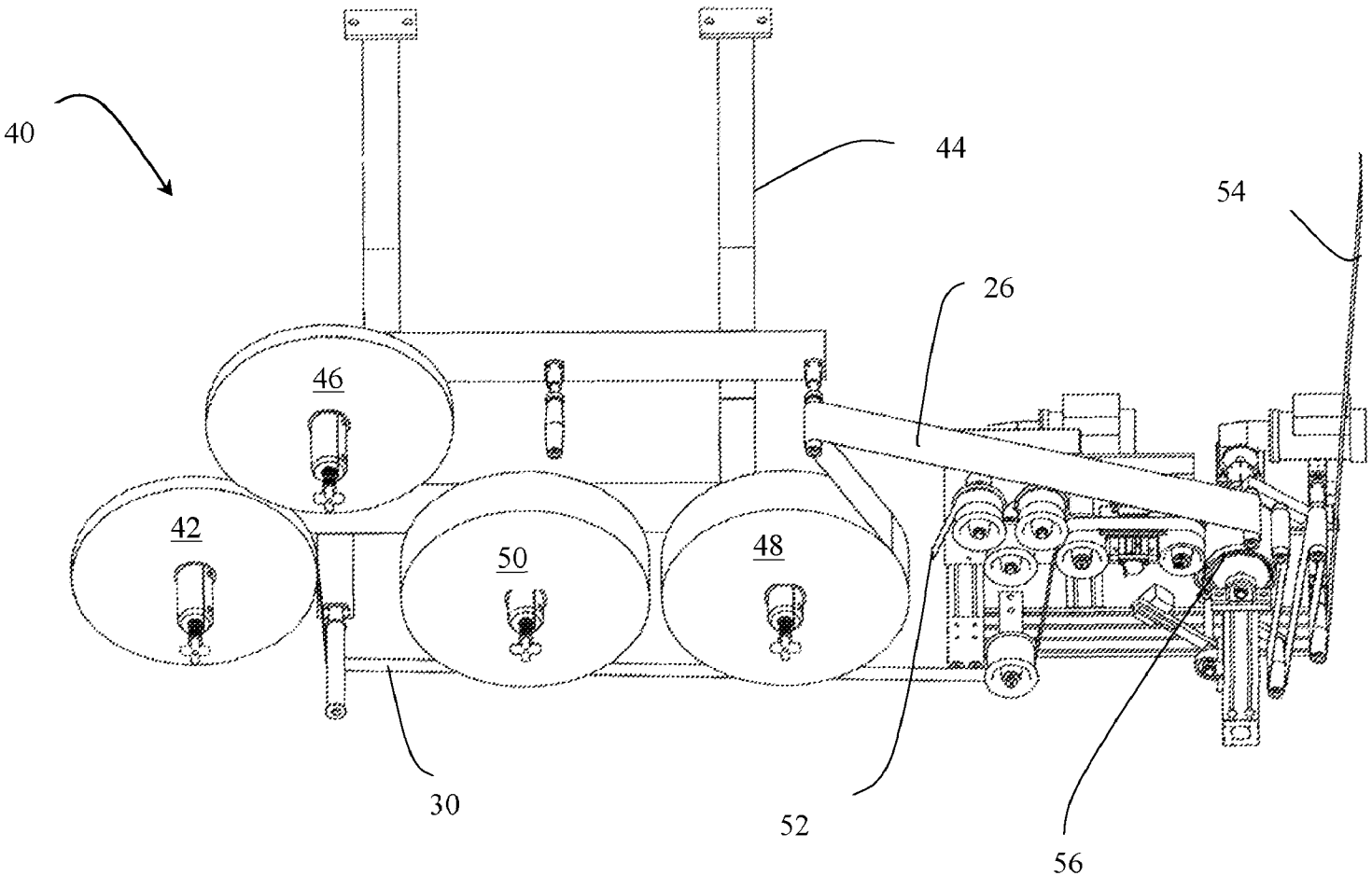
FIG. 4 is a perspective view of the machine of FIG. 3.

Referring to FIGS. 3 and 4, a machine 30 for applying the protective tape 30 to the liner 26 is illustrated. The protective tape 30 is stored on a storage reel 42 which is mounted or a frame 44. A spare reel 46 of protective tape is also mounted on the frame 44 so as to permit the manufacturing operation to continue substantially uninterrupted when the storage reel 42 runs out of protective tape 30. Similarly, a main reel 48 and a back up reel 50 containing the liner 26 are mounted on the frame 44.

In operation, the liner 26 is fed to the machine 40 which, except for the ability to apply the protective tape layer 30, is of known construction, along a path A. Simultaneously, the protective tape 30, mounted on a release liner 52 is fed to the forming machine along a path B. A continuous length of adhesive film 50 either in pancake form or traverse wound is unrolled from the storage reel 42 and introduced to the weather strip liner 26 using custom rollers and adjustable guides to exacting position on the weather strip liner. Before the film reaches the pressure roll where the film and liner are introduced to each other, the film's release liner 52 is stripped away using a scrap takeaway system for disposal or recycling. A complex set of rollers and electronics are used to equalize tension between the film and the liner, and once introduced, the protective tape layer 30 and the liner 26 are laminated via the adhesive exposed by removing the release liner 52. Once laminated in this manner, a finished product 54 including the liner 26 laminated to the protective tape 30 is moved to either a manufacturing cell for immediate use or a take-up reel for further processing. The release liner exits the machine along path D where it is collected for disposal.

When the finished product 54 is to be immediately used, liquid foam is poured onto the liner, after which all the remaining components of the weather strip, for example, rigid insert, are introduced together at one point using proprietary tooling folding all components together. The folded weather strip is encapsulated in a mold and put into an oven whereby the foam cures. After the foam cures the weather strip is removed from the mold where it is wound continuously onto reels or cut to length and placed into boxes for distribution and use in the field.

In another embodiment, not illustrated in the figures, the liner 26 is first attached to the top and bottom surfaces of the base portion 16 of the spine 12, preferably by welding. The foam body 20 is then injected into the interior of the liner 26 as the liner 26 passes through a mold for forming the weatherseal into the shape shown in FIGS. 1 & 2. This seal is then supplied along path A, for example from a reel such as storage reel 48 or directly from an injection machine that supplied the foam. Similar to the embodiment described above, the protective tape 30 is then simultaneously removed from the release liner 52 and applied to the surface of the door seal liner 26 and the finished seal moves either to a manufacturing cell or to a take-up reel for further processing and/or storage along path C.

While the weatherseal with protective coating according to this invention and the method of manufacture thereof has been described in accordance with a presently preferred embodiment, those skilled in the art will recognize that many modifications and changes may be made without departing from the true spirit and scope of the invention which accordingly is intended to be defined solely by the applied claims.

For example, although the weatherseal of the present invention has been defined as having a shape illustrated in FIGS. 1 and 2, the invention is not limited to this cross-sectional shape. Many shapes are used in the weather stripping industry for different applications, and the present invention can be used in connection with any of those shapes. In any embodiment, it is preferable that the protective coating 30 be applied to any sections of the weatherseal that will be exposed and thereby capable of being painted or otherwise degraded during construction and installation of the weather stripping.

The invention claimed is:

1. A weatherseal adapted to be installed in a door or window that is painted after installation of the weatherseal comprising:

a semirigid attaching part characterized by a first coefficient of thermal expansion;

a flexible sealing part, the sealing part including a foam core a layer of fabric material wrapped around the foam core, and a removable protective layer of material applied to the fabric material and selected to have a second coefficient of thermal expansion substantially the same as the first coefficient of thermal expansion.

2. The weatherseal according to claim 1 further comprising of one or more flexible fins depending from the attaching part.

3. The weatherseal according to claim 1, wherein the flexible sealing part is substantially V-shaped.

4. The weatherseal of claim 3, the V-shape comprising a support leg connected to the semi-rigid attaching part and a sealing leg depending from the support leg.

5. The weatherseal according to claim 1, wherein the foam core comprises one of an open and closed cell foam.

6. The weatherseal of claim 5, wherein the foam comprises polyetherurethane.

7. The weatherseal according to claim 1, wherein the removable protective layer comprises a coextruded multipolymer protective tape.

8. The weatherseal according to claim 1, wherein the removable protective layer is applied to the fabric material with an acrylic adhesive.

9. A method of making the weatherseal of claim 1, the method comprising:

supplying a continuous length of the fabric material along a first path;

supplying a continuous length of a protective tape comprising the protective layer mounted on a release liner along a second path;

removing the release liner from the protective tape;

contacting a surface of the protective tape from which the release layer has been removed to the fabric material while continuously moving the protective tape and the fabric material; and pressing the protective tape and the fabric material to adhere the protective tape to the fabric material.

10. The method of claim 9, wherein the fabric material adhered to the protective layer is collected on a take-up reel.

11. The method of claim 9, further comprising forming a liquid foam onto a length of the fabric material on a side opposite the side on which the protective layer is adhered;

folding the fabric material onto the semi-rigid attaching part to envelop the liquid foam in a portion of the semi-rigid attaching part within the fabric material; and curing the foam.

12. The method of claim 11, wherein the protective layer and the semi-rigid attaching part have coefficients of thermal expansion that are substantially the same.

13. The method of claim 9, wherein the pressing is done by a pressure role along which paths A and B pass.

14. A machine for forming the weatherseal of claim 1, the machine comprising:

a mounting frame;

a first supply reel disposed on the mounting frame and containing a continuous length of the protective layer, the protective layer being mounted on a release liner;

a second supply reel disposed on the mounting frame and containing a continuous length of the fabric material;

a stripping station located downstream of the first supply reel for stripping the release layer from the protective tape to expose an adhesive on a first side of the protective tape; and a pressing station located downstream of the stripping station and the second reel pressing the exposed adhesive of the protective tape onto a side of the fabric material to adhere the protective tape to the fabric material.

15. The machine of claim 14 further comprising:

a foaming section, in which a liquid foam is deposited onto the side of the fabric material opposite the side on which the protective tape is adhered;

a forming section in which the fabric material is formed to envelop substantially all of the liquid foam; and and a curing station in which the liquid foam is cured within the molded fabric material.

* * * * *